United States Patent [19]

Gage

[11] Patent Number: 4,476,800

[45] Date of Patent: Oct. 16, 1984

[54] TILLER CONTROL DEVICE

[76] Inventor: John W. Gage, 110 Jumping Brook Rd., Lincroft, N.J. 07738

[21] Appl. No.: 378,198

[22] Filed: May 14, 1982

[51] Int. Cl.[3] ..... B63H 25/52

[52] U.S. Cl. ..... 114/172; 114/144 R; 74/495; 403/377

[58] Field of Search ..... 114/144 R, 144 C, 172; 74/480 B, 493, 495, 522, 532; 403/108, 109, 118, 377

[56] References Cited

U.S. PATENT DOCUMENTS

| | | | |
|---|---|---|---|
| 2,846,896 | 8/1958 | Allen | 114/172 |
| 3,279,410 | 10/1966 | Young | 114/172 |
| 3,584,595 | 6/1971 | Perry, Jr. | 114/172 |
| 4,111,575 | 9/1978 | Hoshino | 403/377 |
| 4,178,869 | 12/1979 | Turrentine | 114/172 |
| 4,188,904 | 2/1980 | Childress | 114/144 R |

*Primary Examiner*—Sherman D. Basinger
*Assistant Examiner*—Jesûs D. Sotelo
*Attorney, Agent, or Firm*—Hedman, Gibson, Costigan & Hoare

[57] ABSTRACT

A tiller control device is provided for controlling the position of a tiller on a watercraft and includes an attachment shaft adapted to be attached to either the tiller or the watercraft, and a variable pressure brake adapted to engage the attachment shaft and adapted to be attached to the other of the tiller or the watercraft. A handle is attached to the variable pressure brake for variably adjusting the amount of the pressure exerted on the attachment shaft, whereby the attachment shaft may remain fixed relative to the brake when unattended but may be moved relative to the brake when desired without further adjustment of the handle.

5 Claims, 2 Drawing Figures

TILLER CONTROL DEVICE

BACKGROUND OF THE INVENTION

The present invention is directed to the field of devices for automatically holding the tiller of a watercraft, such as a sailboat and the like, in a fixed position to thereby allow the heading of the watercraft to remain fixed while the tiller remains unattented, and more specifically to an improved mechanical device employing a variable pressure brake for holding a tiller in a fixed position when unattended or moving it if so desired, without any further adjustment to the variable pressure brake.

Several prior art devices exist which function to maintain a tiller of a watercraft in a fixed position. One such device is taught by Turrentine, U.S. Pat. No. 4,178,869, who discloses a tubular-shaped device which is pivotally attached on one end to the tiller of a watercraft, and on the other end to a portion of the watercraft. Large changes in tiller position may be accomplished by operating a detent button, while fine adjustment of the tiller position may be provided by rotating a portion of the tubular device.

Other devices, such as those taught by Young, U.S. Pat. No. 3,279,410 and Allen, U.S. Pat. No. 2,846,896, each provide a plurality of individual settings at which the tiller may be positioned. Vidach, U.S. Pat. No. 3,221,699, discloses an arcuate assembly fixed to the rudder and tiller which may be secured in a fixed position relative to the boat by means of a shaft actuated clamping foot.

Although in each of the above the tiller holding and steering devices provide a certain degree of tiller control, several drawbacks to each of these devices exist. For example, none of the above devices allow tiller adjustment without an associated adjustment of the tiller control device, thus requiring a pair of operations to move the tiller. The control devices must be adjusted to effect movement of the tiller, or the tiller must be disengaged from the tiller control device. Thus, the prior art tiller control devices are generally cumbersome and their use may not be advisable whenever rapid tiller adjustments must be made on a moment's notice.

Still other tiller control devices either require electrical or wind power to operate and involve the use of complex mechanisms. Further, many of the prior art tiller control devices are unable to effect micro adjustments in the tiller position and maintain the tiller in the readjusted position without tiller slippage.

OBJECTS AND SUMMARY OF THE INVENTION

It is therefore an object of the invention to overcome the shortcomings associated with the prior art tiller control devices.

It is a further object of the invention to provide a highly reliable technique of holding the tiller in a fixed position while allowing the tiller to be moved a large or small distance at a moment's notice, without having to perform any adjustments to the tiller control device or disengaging the tiller from the tiller control device.

It is a further object of the invention to provide a technique of tiller control which eliminates tiller slippage.

In accordance with a first aspect of the invention, a tiller control device for controlling the position of a tiller on a watercraft includes an attachment device adapted to be attached to either of the tiller or the watercraft, and a variable pressure brake adapted to operatively engage the attached device for exerting pressure thereon. The brake is adapted to be attached to the other of the tiller or the watercraft. A control device is attached to the brake and is provided for variably adjusting the amount of the pressure exerted on the attachment device, whereby the attachment device may remain fixed relative to the brake when unattended but may be moved relative to the brake if so desired without further adjustment of the control device.

More specifically, the attachment device is preferably in the form of a shaft and the variable pressure brake preferably includes: an outer casing, an axially disposed cavity within the outer casing, and a brake sleeve axially disposed within a predetermined portion of the cavity in abuttment with the inner surface of the outer casing, the shaft being disposed within the brake sleeve. The control device is in communication with the brake sleeve and acts to impart a radially inward force on the brake sleeve such that the brake sleeve is forced to bear upon the shaft with an amount of pressure determined by the control device.

In accordance with the preferred embodiments, the brake sleeve is tube-shaped and formed from a strip of resilient plastic material wound substantially in a helical manner.

The control device may include an adjustment bolt threadedly secured to the outer casing and a brake shoe disposed between the brake sleeve and the adjustment bolt. The radially inward force is applied directly from the brake shoe to the brake sleeve and may be adjusted by turning the adjustment bolt in the outer casing.

Ideally, the outer casing, the cavity, the brake sleeve and the shaft are generally cylindrical in shape and substantially concentric. The outer casing is preferably adapted to be pivotally attached to a portion of the watercraft and the shaft is adapted to be pivotally attached to the tiller.

In accordance with a second aspect of the invention, a process of controlling the position of a tiller on a watercraft includes the steps of attaching a shaft to either of the tiller or the watercraft, attaching a variable pressure brake to the other of the tiller or watercraft, operatively engaging the shaft with the variable pressure brake, and exerting a selected and variable amount of pressure on the shaft from the brake. The shaft may be allowed to remain fixed relative to the variable pressure brake when unattended, or may be moved relative to the variable pressure brake without changing the variable amount of pressure, when so desired.

In accordance with the preferred embodiment, the steps of attaching include attaching the shaft to the tiller and attaching the variable pressure brake to the watercraft.

BRIEF DESCRIPTION OF THE DRAWINGS

These and other objects, aspects and embodiments of the invention will be further described with reference to the following drawing figures of which.

1, illustrating the variable pressure brake employed therein.

DETAILED DESCRIPTION OF THE INVENTION

Figure 1:
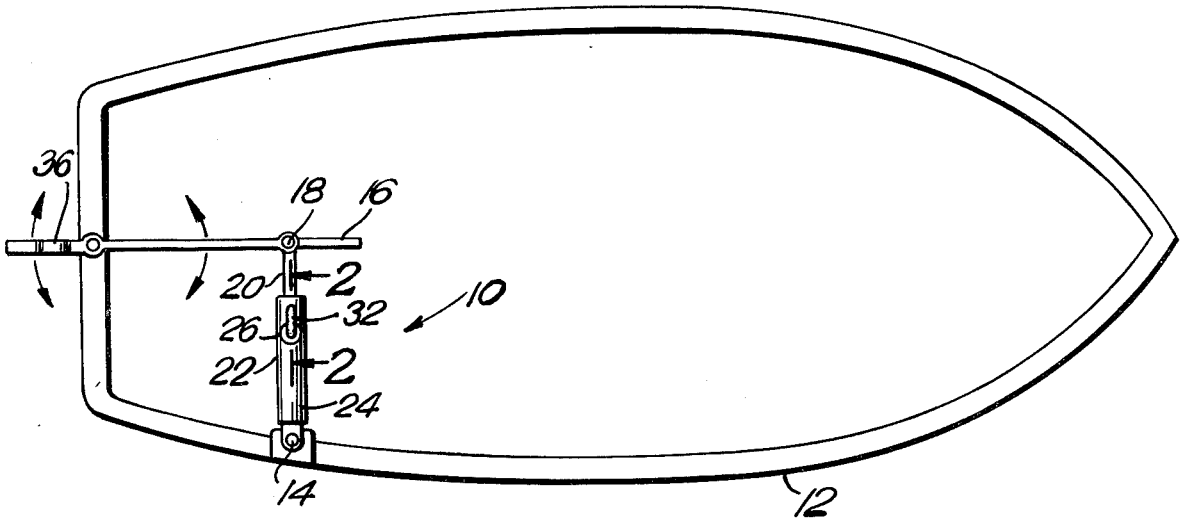
FIG. 1 is a top plan view of the tiller control device in accordance with the present invention as employed in a watercraft.

With reference to FIG. 1, the tiller control device 10 is attached at one end to watercraft 12 by means of a first hinge or pivot point 14, and to tiller 16 by means of a second hinge or pivot point 18. The tiller control device 10 comprises an adjustment shaft 20 connected at pivot point 18 and a variable pressure brake 22 connected at pivot point 14. However, it will be appreciated that the shaft 20 and brake 22 can be attached to pivot points 14 and 18, respectively, if so desired. Variable pressure brake 22 is comprised of an outer casing 24 and control means 26 formed in a portion of the outer casing 24. Preferably, the attachment shaft 20 and the outer casing 24 are generally cylindrical, the outer casing being provided with an axially disposed cavity 30 (FIG. 2) into which the attachment shaft 20 is disposed. However, other shapes of attachment means 20 and variable pressure brake 22 will be suggested to those skilled in the art.

Figure 2:
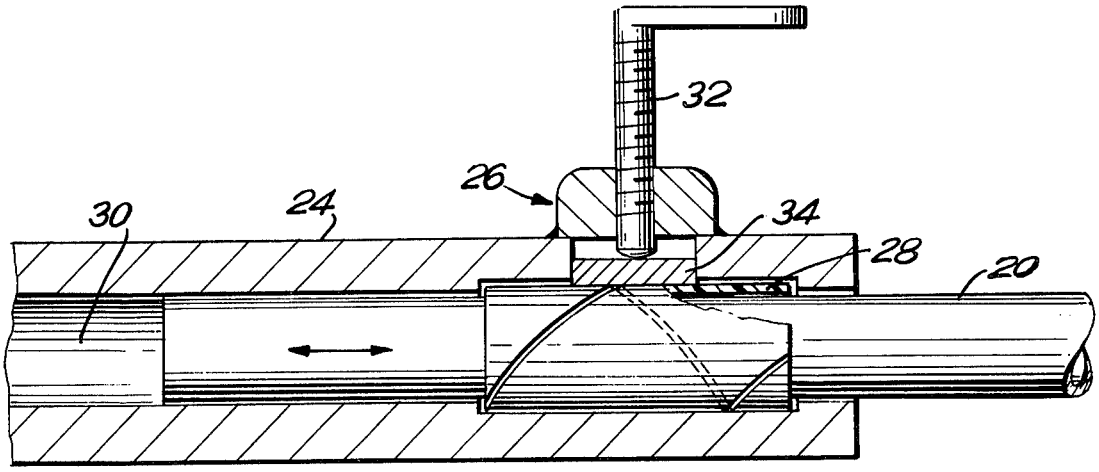
FIG. 2 is a cross-sectional view of the portion of the tiller control device taken through section 2—2 of FIG.

With further reference to FIG. 2, the variable pressure brake is formed by brake sleeve 28 which is located at a preselected portion of the outer casing 24 within the axially disposed cavity 30 such that the brake sleeve 28 is in abuttment with the inner surface of the outer casing 24. The attachment shaft 20 is disposed within the cavity 30 such that it is surrounded by brake sleeve 28. The brake control 26 comprises an adjustment bolt 32 threadedly secured to a reinforced portion of the outer casing 24, and a brake shoe 34 disposed between, and in communication with, the adjustment bolt 32 and the brake sleeve 28.

The brake sleeve in accordance with the present invention is comprised of a resilient plastic material, such as polyvinyl chloride. The brake sleeve is generally tube-shaped and may be formed from a strip of the resilient plastic material wound in a helical manner in much the same way as a paper towel tube is formed, with the seams thereof separated. By winding the strip of plastic material to form the brake sleeve 28, the inner diameter of the brake sleeve 28 may be constricted by adjusting the adjustment bolt 32 to apply a radial force to the brake shoe 34, which in turn imparts a radial force directly to the brake sleeve. In response to the radial force, the helically wound resilient plastic material will constrict to form a tighter tube of smaller inner diameter to thereby grip the shaft 20 with increasing force. Likewise, by releasing the pressure on the brake sleeve, the resilient material will relax and provide a larger inner diameter which loosely surrounds shaft 20. By adjusting the adjustment bolt 32, a precise amount of gripping force may be applied to shaft 20.

Thus, the amount of force required to move shaft 20 within the variable pressure brake 22 can be varied by adjusting adjustment bolt 32. By adjusting the adjustment bolt 32 such that very little pressure is applied to the brake shoe 34, attachment shaft 20 will be able to move freely within the cavity 30. On the other hand, by applying a great deal of pressure to brake shoe 34, effectively no movement of shaft 20 within cavity 30 will be available. At all settings inbetween, the amount of force required to move shaft 20 within cavity 30 is directly proportional to the amount of pressure applied to the brake shoe 34 by the adjustment bolt 32.

In operation, rudder 36, FIG. 1, and the tiller 16 may be moved to a desired position and the adjustment bolt 32 tightened to a degree which will produce sufficient pressure on the brake shoe 34 to hold the attachment shaft 20 in the desired position while the tiller is unattended, but loose enough so that the operator can move the tiller to any other desired position without any other further adjustment of the adjustment bolt. Although the tiller will remain in a fixed position while unattended due to the existing brake pressure on the shaft 20, large or small variations in the position of the tiller may be immediately effected without any further adjustment of the tiller control device by manually moving the tiller as desired. Due to the use of the resilient plastic brake sleeve 28, the force imparted to shaft 20 is very positive, and the new position selected for the tiller will be maintained without any adjustment to device 10 and without any tiller slippage experienced with prior art devices.

Although the present invention has been described with reference to the foregoing specification and drawings, the scope of the invention will now be defined with reference to the following claims.

What is claimed is:

1. A tiller control device for controlling the position of a tiller on a watercraft, comprising:

a shaft adapted to be attached to one of said tiller and said watercraft;

a variable pressure brake adapted to operatively engage said shaft for exerting pressure thereon, said brake adapted to be attached to the other of said tiller and said watercraft; said variable pressure brake comprising:

an outer casing;

and control means for selectively positioning said tiller are attached to said brake for variably adjusting the amount of said pressure exerted on said shaft; an axially disposed cavity within said outer casing; and a brake sleeve axially disposed within a predetermined portion of said cavity in abuttment with at least a portion of the inner surface of said outer casing, said shaft being disposed within said brake sleeve, said control means being in communication with said brake sleeve and acting to impart a radially inward force on said brake sleeve such that said brake sleeve is forced to bear upon said shaft with a pressure determined by said control means; said control means comprising an adjustment bolt threadedly secured to said outer casing, and a brake shoe disposed between said brake sleeve and said adjustment bolt, whereby said radially inward force is applied radially to the axis of said shaft by said adjustment bolt directly from said brake shoe to said brake sleeve and may be adjusted by turning said adjustment bolt, whereby said shaft may remain fixed relative to said brake when unattended but may be moved relative to said brake when desired without further adjustment of said control means.

2. The tiller control device of claim 1 wherein said brake sleeve is comprised of a resilient plastic material.

3. The tiller control device of claim 2 wherein said brake sleeve is generally tube-shaped and formed from a strip of said resilient plastic material wound substantially in a helical manner.

4. The tiller control device of claim 1 wherein said outer casing, said cavity, said brake sleeve and said shaft are generally cylindrical in shape and substantially concentric.

5. The tiller control device of claim 1 wherein said outer casing is adapted to be pivotally attached to a portion of said watercraft and said shaft is adapted to be pivotally attached to said tiller.

* * * * *